US007549479B2

(12) United States Patent
Biegler et al.

(10) Patent No.: US 7,549,479 B2
(45) Date of Patent: Jun. 23, 2009

(54) TUBULAR FLOTATION WITH PRESSURIZED FLUID

(75) Inventors: Mark W. Biegler, Houston, TX (US); Bruce A. Dale, Sugar Land, TX (US)

(73) Assignee: ExxonMobil Upstream Reseach Company, Houston, TX (US)

( * ) Notice: Subject to any disclaimer, the term of this patent is extended or adjusted under 35 U.S.C. 154(b) by 273 days.

(21) Appl. No.: 11/667,221

(22) PCT Filed: Nov. 7, 2005

(86) PCT No.: PCT/US2005/040119

§ 371 (c)(1),
(2), (4) Date: May 7, 2007

(87) PCT Pub. No.: WO2006/065393

PCT Pub. Date: Jun. 22, 2006

(65) Prior Publication Data

US 2007/0295513 A1 Dec. 27, 2007

Related U.S. Application Data

(60) Provisional application No. 60/635,338, filed on Dec. 10, 2004.

(51) Int. Cl.
*E21B 43/10* (2006.01)
*E21B 33/14* (2006.01)

(52) U.S. Cl. ..... 166/381; 166/77.1; 166/380; 166/192

(58) Field of Classification Search ..... 166/380, 166/381, 386, 192, 285, 77.1
See application file for complete search history.

(56) References Cited

U.S. PATENT DOCUMENTS 3,398,794 A 8/1968 Fox, Jr.
3,526,280 A 9/1970 Aulick (Continued)

FOREIGN PATENT DOCUMENTS

EP 0 846 839 A2 6/1998
WO WO 2006/101606 A2 9/2006

OTHER PUBLICATIONS

European Search Report No. 112340, dated May 24, 2005, 4 pages.

(Continued)

*Primary Examiner*—Kenneth Thompson

(57) ABSTRACT

In one embodiment, a method of installing tubular conduits (for example, casing, liners, sand screens) into a deep or highly deviated borehole is disclosed. A lower plug (1) is attached at one end of a portion of a tubular conduit. This end is inserted into a borehole. After insertion into the borehole the desired length of conduit intended to resist internal collapse forces and be substantially buoyant, a plug (4) is attached at the upper end. The plug has a valve (5) designed to enable fluid communication between the pressurized fluid section and the insertion string. A pump is attached to the valve and the pressurized fluid is added to the pressurized fluid section, after which the valve is closed. After the tubular conduit is inserted to the desired depth, the valve is opened allowing the pressurized fluid flow out of the pressurized fluid section. Conventional well construction activities may then resume.

37 Claims, 3 Drawing Sheets

U.S. PATENT DOCUMENTS

| | | | |
|---|---|---|---|
| 4,384,616 | A | 5/1983 | Dellinger |
| 4,882,830 | A | 11/1989 | Carstensen |
| 4,986,361 | A | 1/1991 | Mueller et al. |
| 5,117,915 | A | 6/1992 | Mueller et al. |
| 5,150,756 | A | 9/1992 | Hassanzadeh |
| 5,181,571 | A | 1/1993 | Mueller et al. |
| 5,275,242 | A | 1/1994 | Payne |
| 5,316,091 | A | 5/1994 | Rasi et al. |
| 5,829,526 | A | 11/1998 | Rogers et al. |
| 6,505,685 | B1 | 1/2003 | Sullaway et al. |
| 6,622,798 | B1 | 9/2003 | Rogers et al. |
| 6,634,430 | B2 | 10/2003 | Dawson et al. |
| 6,651,748 | B2 | 11/2003 | Sullaway et al. |
| 6,758,281 | B2 | 7/2004 | Sullaway et al. |
| 2004/0060709 | A1 | 4/2004 | Vidrine et al. |

OTHER PUBLICATIONS

International Search Report and the Written Opinion of the International Searching Authority, mailed Jun. 7, 2006 for PCT/US05/40119, 7 pages.

TUBULAR FLOTATION WITH PRESSURIZED FLUID

CROSS RELATED APPLICATIONS

This application is the National Stage of International Application No. PCT/US2005/040119, filed Nov. 7, 2005, which claims the benefit of U.S. Provisional Application No. 60/635,338, which was filed on Dec. 10, 2004.

FIELD OF THE INVENTION

This invention relates generally to the field of well drilling and, in particular, to installation of casing or liners into oil and gas well boreholes. Specifically, the invention is an improved method of flotation of these well tubulars into deep or highly deviated well boreholes.

BACKGROUND OF THE INVENTION

This section is intended to introduce the reader to various aspects of art, which may be associated with exemplary embodiments of the present techniques, which are described and/or claimed below. This discussion is believed to be helpful in providing the reader with information to facilitate a better understanding of particular aspects of the present techniques. Accordingly, it should be understood that these statements are to be read in this light, and not as admissions of prior art.

Tubular conduits, often referred to as casing or liners, are inserted into boreholes following the drilling of the borehole. In some cases, insertion of these tubular conduits is problematic due to the characteristics of the borehole. Characteristics of the borehole that can make insertion difficult or impossible include high friction between the borehole wall and tubular conduit, high inclination of the borehole, extended horizontal reach of the borehole relative to the mudline or surface location of the well, great depth of the borehole relative to the structural capacity of the surface equipment used to install the conduit, and a subsurface trajectory that features frequent or relatively severe changes in well angle or direction.

One method currently used to install tubulars in boreholes that feature these characteristics is to fill a section of the tubular with a fluid (a liquid or a gas) that has a lower density than the liquid contained inside the borehole. As the tubular is lowered into the borehole, this difference in fluid density provides partial or complete buoyancy of the tubular section containing the lighter fluid. This buoyancy reduces the forces resisting or preventing conduit insertion and thus aids in and allows conduit insertion. More specifically, a plug is placed at the distal end of the tubular, and the tubular is inserted into the wellbore while filling the tubular section with a light fluid (relative to the liquid in the borehole).

After insertion of a significant amount of fluid-filled tubular filled with light fluid or gas into the wellbore, a second or proximal plug is placed within the tubular to trap the light fluid in place. The actual amount can be up to a few kilometers (a few thousand feet) depending upon the specific geometry of the borehole. This section of tubular is buoyed by the heavier fluid in the borehole as it is inserted into the borehole using tubulars. The tubulars can be further inserted into the well borehole with either additional casing or pipe used as an insertion string which are attached to this section of tubular above the proximal plug and contain fluid typically more dense than the light fluid of the buoyed section. An example illustration of this method is described in detail in U.S. Pat. No. 5,117,915.

Another method currently used to install tubulars in boreholes that feature these characteristics is to fill an annulus between a concentric insertion tubular string and the casing or liner with a fluid. The fluid has a lower density than the liquid contained inside the borehole. Similar to the method described above, the difference in fluid density in this insertion-string-by-casing annulus and the density of the fluid in the borehole provides partial or complete buoyancy of the tubular section as it is inserted into the borehole. An example illustration of this method is also described in detail in U.S. Pat. No. 5,117,915.

While these existing methods can be effective in installing tubulars in boreholes that feature these characteristics there are some difficulties associated with these existing methodologies. Specifically, the light fluid provides buoyancy to the tubular at a pressure that is less than that in the wellbore. This can lead to structural collapse of the tubular and loss of well utility.

For instance, if the fluid is a gas, then by conventional flotation methods the pressure in the buoyed interval is essentially atmospheric. Further, gases at near-atmospheric pressure are very compressible. As such, the inserted tubular's resistance to collapse should be provided by the tubular alone. There is no internal pressure to help counteract the external pressure that works to crush the tubular. If the fluid is a compressible liquid (such as, oil or diesel), the pressure in the buoyed portion of the tubular may be above atmospheric pressure but still below the in-wellbore pressure. As such, the inserted tubular's net collapse resistance is less than it may be if open to surface and filled with the same mud as is in the wellbore annulus. The net collapse resistance includes both the mechanical strength of the tubular wall and the internal pressure in the tubular.

Also, the wall thickness of the inserted tubular has an effect on the difficulty associated with floating a casing or liner into a deviated wellbore interval. Specifically, the thicker the wall in the floated interval, the heavier the pipe in the floated interval. Increasing the wall thickness increases the weight which leads to increased drag for a fixed fluid density in the annulus. Increased drag can prevent insertion of a floated casing or liner into a deep or deviated wellbore interval. Therefore, it is advantageous from an insertion standpoint to use casing or liner with thinner wall. However, reducing a thickness exacerbates the tubular collapse problem associated with the conventional method. The thinner the wall, the less capacity the tubular has to resist collapse.

Accordingly, there is a need for an improved tubular insertion methodology that preferably allows buoyant insertion of tubulars without concern for collapse due to pressure differences in and out of the tubular.

SUMMARY OF THE INVENTION

In a first embodiment, a method for inserting a conduit into a well borehole penetrating a subterranean formation is disclosed. The method comprises plugging at least a portion of a conduit with an upper plug and a lower plug, inserting pressurized fluid into the plugged portion of the conduit, placing the plugged portion of the conduit at a desired placement location within a well borehole, and allowing pressurized fluid to flow out of the plugged portion of conduit.

In a second embodiment, a method for inserting a conduit into a well borehole penetrating a subterranean formation is disclosed. The method comprises plugging at least a portion of the annulus between a conduit and an insertion string with an upper annular plug and a lower annular plug, inserting pressurized fluid into the plugged portion of the annulus between the conduit and the insertion string, placing the conduit at a desired placement location within a well borehole, and allowing the pressurized fluid to flow out of the plugged portion of the annulus between the conduit and the insertion string.

In a third embodiment, a method for inserting a conduit into a borehole penetrating a subterranean formation is disclosed. The method comprises securing an insertion string co-axially within the conduit, plugging at least a portion of the insertion string with an upper plug and a lower plug, inserting pressurized fluid into the plugged portion of the insertion string, placing the conduit at a desired placement location within a well borehole, and allowing the pressurized fluid to flow out of the plugged portion of the insertion string.

BRIEF DESCRIPTION OF THE DRAWINGS

The present invention and its advantages will be better understood by referring to the following detailed description and the attached drawings in which.

DETAILED DESCRIPTION OF THE INVENTION

The present invention will be described in connection with its preferred embodiments. However, to the extent that the following description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

This invention provides a method for buoyancy-aided insertion of a tubular conduit into a borehole by adding pressurized fluids to a section of the conduit, thus increasing the resistance of the conduit to collapse and/or improving buoyancy. The pressurized fluids may include gases, liquids, foams, and any combination thereof.

One preferred embodiment is to add pressurized foam to the inside of the conduit. In this embodiment, the amount of pressure may be sufficient to prevent the tubular from collapsing, considering the pressure in the well borehole and the structural properties of the conduit. Typically, the pressure should be at least 1.7 MPa (250 psi), more preferably at least 6.9 MPa (1000 psi) and may be 13.8 MPa (2000 psi) or more. However, the actual preferred pressure of the pressurized fluid may fluctuate as the optimum pressure depends on the specific profile of each well borehole, the density of the fluid in the well borehole, and the wall strength of the conduit.

In a preferred embodiment, the inventive method utilizes a pressurized foam trapped within the inserted tubular conduit to provide buoyancy to the conduit and to resist external collapse forces acting on the conduit as the conduit is inserted into a borehole filled with fluid. Conventional methods of tubular conduit buoyancy employ a non-pressurized fluid trapped within the conduit to provide the relative buoyancy but offers reduced or no non-structural resistance to collapse relative to non-floated conduit.

Alternatively, in other conventional methods, a pressurized fluid may be utilized, but does not address the use of foam or even pressurized fluids in certain applications. For example, in U.S. Pat. No. 3,526,280 to Aulick, pressurizing gas or liquid within a conduit to assist in preventing conduit collapse is described. However, the use of foam as described in the present technique has advantages over liquid or gas in certain applications. Specifically, foam is typically lighter than liquid, thereby providing better conduit buoyancy. Further, while foam is slightly more dense than gas, the greater viscosity of the foam relative to gas allows the foam to be circulated out of the well more slowly than a gas. This provides an efficient mechanism for controlling pressures throughout the wellbore during this circulation.

Figure 1:
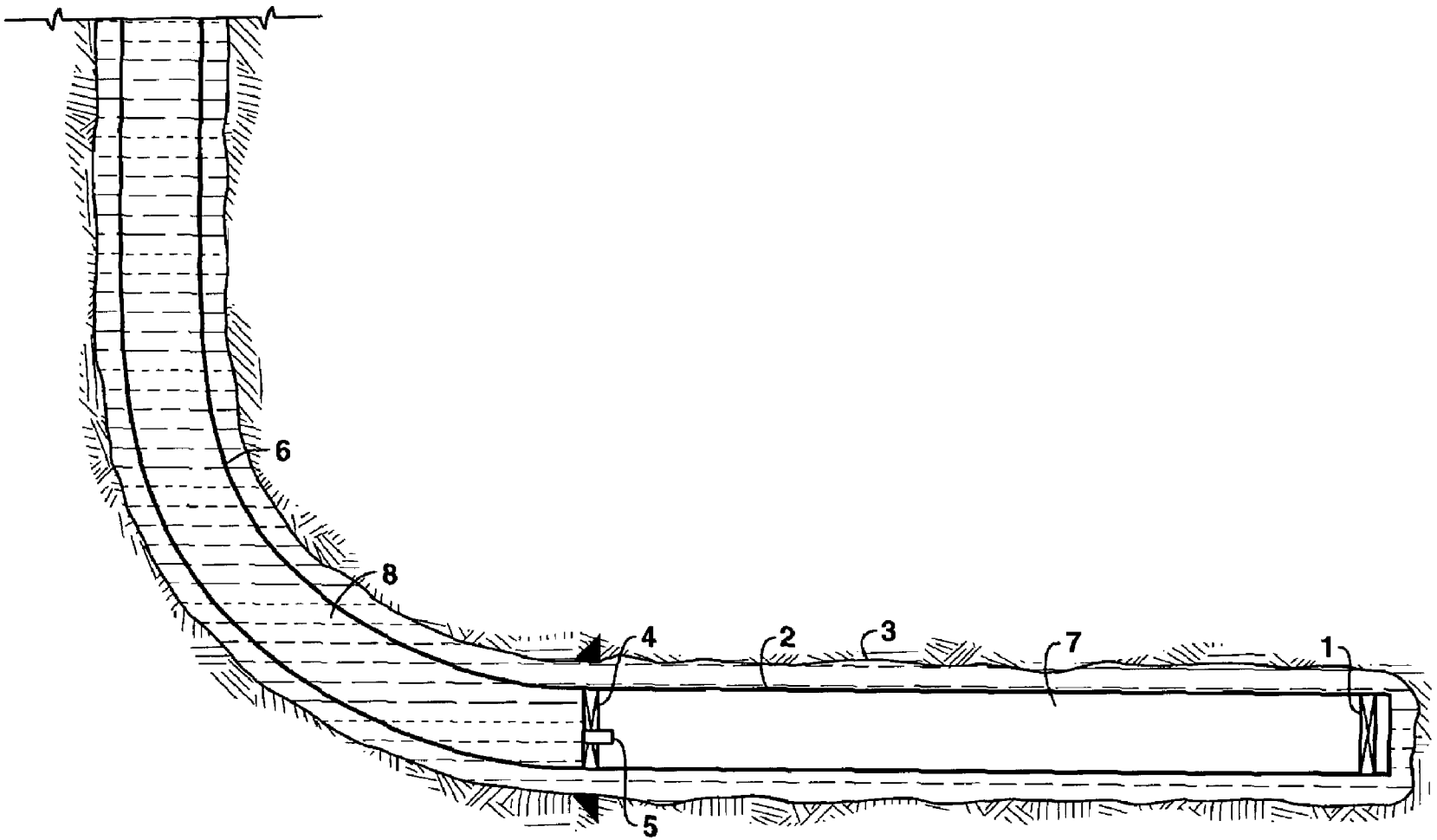
FIG. 1 is a cross-sectional illustration of an embodiment of the current invention for conduit insertion wherein the pressurized section consists of the space within the conduit between an upper plug and a lower plug.

FIG. 1 illustrates the preferred embodiment of the current invention. First, a lower plug 1 is placed within the deepest part of the conduit 2 while this part of the conduit is at the surface. The plug may be a traditional plug, tubular toe or any equivalent device that can prevent fluid communication. More joints to the conduit 2 may be assembled on the top of the conduit 2 hanging in the well while the conduit 2 is inserted piecewise into a borehole or hole 3. Foam at atmospheric pressure may be added to the conduit at practical intervals as the conduit is run into the well. Once the entire portion or section 7 of conduit that is to be pressurized is hanging in the well from the surface, the upper plug 4 is inserted in the conduit. Then, a pressurized tubular is achieved by inserting pressurized fluid, which may be foam, in the section 7 of conduit between the lower and upper plugs 1 and 4. Alternatively, air or another fluid may be left in the conduit 2 as it is run in the well. Then, once upper plug 4 is inserted, a pressurized tubular can be achieved by inserting pressurized foam into the conduit 2. The internal pressure of the pressurized conduit section 7 between the plugs 1 and 4 is typically chosen to achieve a favorable conduit resistance to external collapse forces. It should be noted that the insertion of the pressurized fluid, which may include foam, into the plugged portion of the conduit 2 may be performed external to the well borehole or may be performed while the plugged portion of the conduit 2 is at least partially exposed from the well borehole.

There are many practical methods to create a pressurized section in the conduit. These methods may include compressors, rotary pumps, vapor pumps, or any other pump device. In this embodiment, the pump device (not shown) is temporarily attached to a valve 5 affixed in the upper plug 4 of the conduit, while the upper plug 4 is exposed at the surface. The fluid is pumped into the conduit section 7 to the desired pressure, the valve 5 in the upper plug 4 is closed, and the pump device is removed. The casing is then run into the hole 3. After the conduit reaches the desired final position, the barrier imposed by the upper plug 4 is then removed. The upper plug 4 may be designed so that it collapses or slides to the lower end of the conduit 2, when exposed to pressure above a certain threshold. Alternatively, the upper plug 4 may be designed so that the application of pressure above a certain threshold opens the valve 5 in the upper plug 4. The pressurized fluid in the conduit section 7 below the upper plug 4 flows out of the pressurized conduit section 7, mixing with the fluid 8 in the top section 6. Conventional well construction activities, such as cementing the tubular conduit in the well borehole, for example, may then resume. In one embodiment, the other sections of the conduit that are not pressurized may be made of higher strength material or may have thicker walls to withstand the external collapse pressures.

Figure 2:
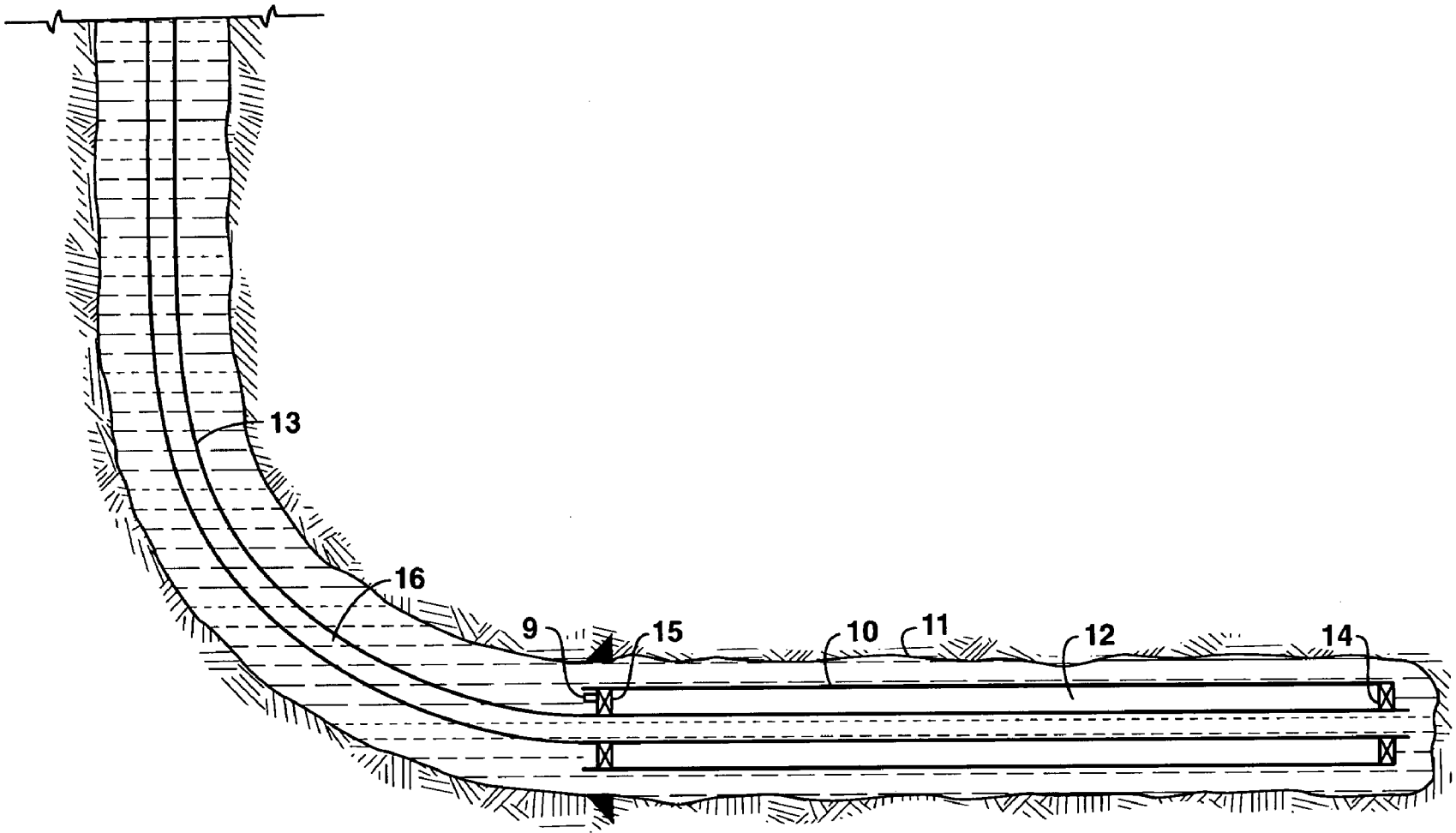
FIG. 2 is a cross-sectional illustration of a second embodiment of the current invention for buoyancy-aided conduit insertion wherein the pressurized section consists of the space within the annulus, between the insertion string and the tubular conduit, between an upper plug and a lower plug.

FIG. 2 illustrates another possible embodiment of the invention that includes the potential to circulate drilling fluids during insertion of a tubular conduit 10 into a hole or borehole 11. Using methods and components similar to those described above, the annulus 12 between an insertion string 13 run within the tubular conduit 10, and lower annular plug 14 and upper annular plug 15 is pressurized. Again, the pressurization of the portion of the conduit may be performed by pumping pressurized fluid (gas, liquid, or foam or some combination of these) into the annulus through a valve 9 affixed in the upper annular plug 15 while the upper annular plug 15 is still at the surface. Once the insertion of the tubular conduit 10 within the borehole 11 is completed, this method allows pressurized fluid to leave the pressurized annulus 12 by withdrawing the insertion sting 13 from the lower annular plug 14. In this case, pressurized fluid flows out of the annulus 12 and mixes with the fluid 16 in both the insertion string 13 and the borehole 11. Conventional well construction activities may then resume, as noted above. Alternatively, it should be noted that the valve 9 may also be utilized in the similar manner as discussed above with regard to the valve 5 of FIG. 1.

Figure 3:
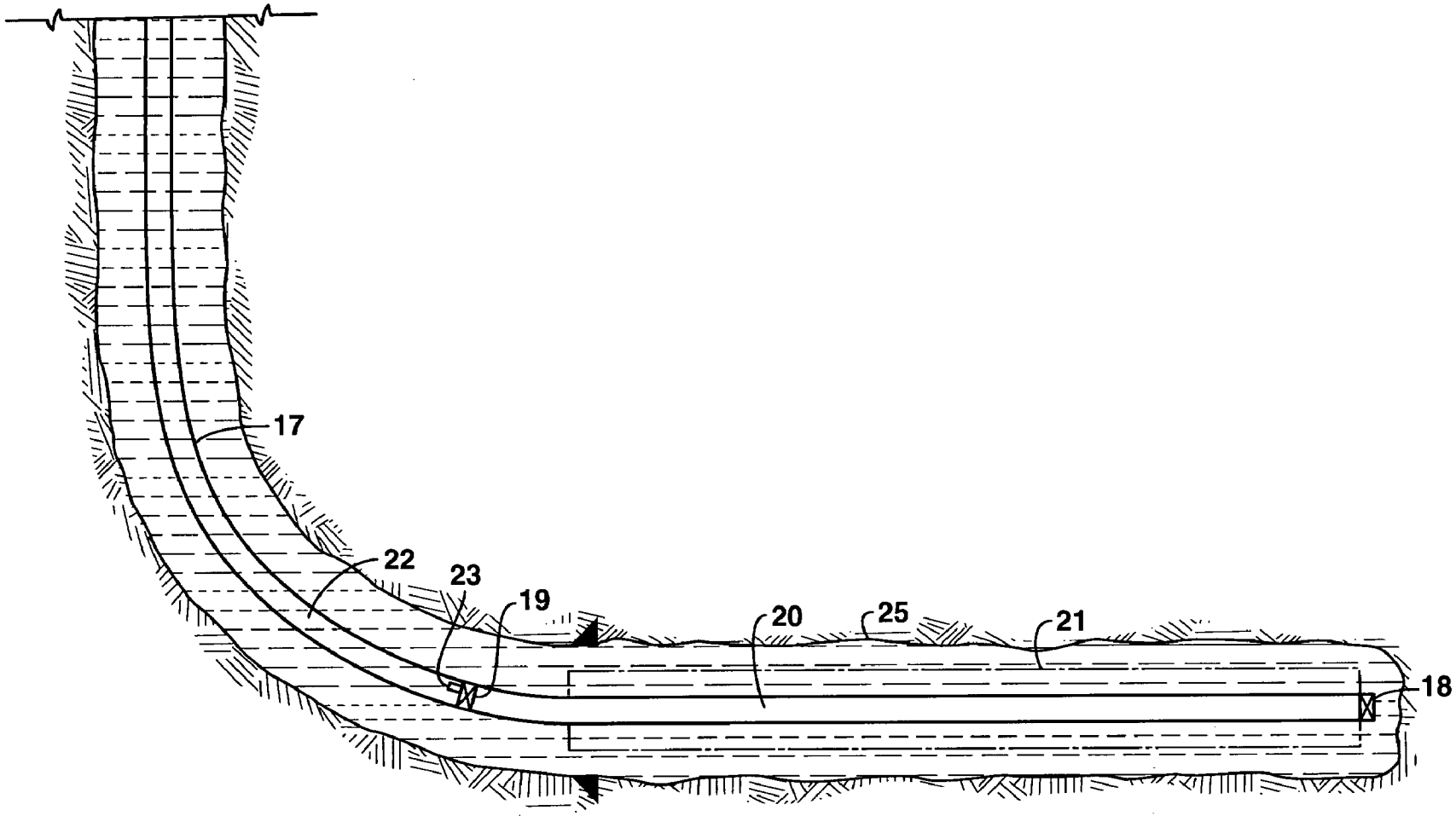
FIG. 3 is a cross-sectional illustration of a third embodiment of the current invention for buoyancy-aided conduit insertion wherein the pressurized section consists of the space within the insertion string between an upper plug and a lower plug.

FIG. 3 illustrates another variation of the invention applied to the insertion of conduit sections that cannot be pressurized, such as sand exclusion devices within boreholes. Again, the method and components may be similar to those described above in FIGS. 1 and 2. In FIG. 3, sand exclusion devices, such as conduit section 21, are installed into a well borehole 25. As the conduit section is perforated, it cannot be used to contain a pressurized section. Accordingly, in this embodiment, a pressurized portion or section 20 is achieved in the insertion string 17, between a lower plug 18 and an upper plug 19. The pressurization may be achieved by pumping pressurized fluid (gas, liquid, foam, or some combination of these) into the pressurized section through a valve 23 affixed in the upper plug 19 while the upper plug 19 is still at surface. This pressurized section 20 of the insertion string 17 may not afford as much buoyancy as a larger-diameter evacuated section. However, the buoyancy forces created may allow insertion of a conduit section 21, which may be a sand exclusion tool, in cases where insertion may otherwise not be practical. Once the conduit section 21 has been inserted, the upper plug 19 is removed and pressurized fluid is allowed to leave the pressurized section 20 with these fluids mixing with fluid 22 in the insertion string 17. Again, it should be noted that the valve 23 may be utilized in manners similar to those discussed above with regard to the valve 5 of FIG. 1 to release the pressurized fluid from the pressurized section 20. Then, the insertion string 17 may then be removed and conventional well construction activities may then resume, as noted above.

EXAMPLE 1 (COMPARATIVE)

A tubular conduit is inserted without rotation into a borehole. In this example, the conduit is a 244 millimeter (9⅝ inch) diameter liner with wall thickness of 10 millimeter (0.395 inches) made of steel with 550 MPa (80,000 psi) yield strength. The tubular may collapse at a vertical depth where the pressure is approximately 21.3 MPa (3,090 psi) if this tubular was run into a well using the conventional gas flotation method. Assuming the liquid in the well borehole has a density of 1.44 gram per cubic centimeter (g/cc) (12 pound-per-gallon), the depth of tubular collapse may be approximately 1,510 meters (4,952 feet). If the conventional gas flotation method is used and the tubular is run to a vertical depth of 1,829 meters (6,000 ft), then a heavier wall tubular may be employed. However, using a heavier wall liner increases the weight of the liner, thereby increasing the frictional drag resisting insertion, potentially preventing running the liner and eliminating the utility of the well.

EXAMPLE 2 (ILLUSTRATIVE)

A tubular conduit is inserted without rotation into a well borehole. In this example, a 244 mm (9⅝-inch) diameter liner with wall thickness of 10 mm (0.395 inches) made of steel with 550 Mpa (80,000 psi) yield strength with 10.3 MPa (1,500 psi) of foam trapped in the floated portion of the conduit. The example fluid in the borehole has a density of 1.44 g/cc (12 pounds per gallon). With the pressurized foam, the effective collapse rating of the conduit is raised from approximately 21.3 MPa (3,090 psi) to approximately 30.8 MPa (4,467 psi). Wherein the pressure in the 1.44 g/cc (12 pound per gallon) well borehole fluid at a vertical depth of 1,829 meters (6,000 ft) is approximately 25.8 MPa (3,744 psi), the tubular run with the pressurized flotation method could be run to bottom without collapse.

As noted above, the use of a stable foam as the pressurized fluid within the conduit is one embodiment. In this embodiment, the amount of pressure may preferably be sufficient to prevent the tubular from collapsing, considering the pressure in the well borehole and the structural properties of the conduit. A stable foam may provide advantages over a gas because special operational procedures may be needed to circulate a gas out of the conduit once the conduit is in place. The use of these specialized procedures are noted by Dawson and Biegler in U.S. Pat. No. 6,634,430. Being more viscous, the foam could be moved more slowly than a gas as it is being circulated out, potentially allowing better control of pressures throughout the well borehole. Therefore, the stable foam may simplify the operations utilized to remove the internal fluid from the conduit once the conduit has been placed in the well.

A disadvantage of the foam relative to the pressurized gas method is that the foam may have a slightly higher density than the gas, thus slightly increasing the weight of the conduit relative to the gas. However, this weight increase may be small relative to the overall conduit weight, thus only minimally impacting the insertion of the conduit.

What we claim is:

1. A method for inserting a conduit into a well borehole penetrating a subterranean formation, the method comprising:

plugging at least a portion of a conduit with an upper plug and a lower plug;

inserting foam into the plugged portion of the conduit;

placing the conduit within a well borehole, wherein the plugged portion of the conduit is disposed at a desired placement location within the well borehole; and allowing the foam to flow out of the plugged portion of the conduit.

2. The method of claim 1, wherein additional non-pressurized conduit portions are attached to an upper end of the plugged portion of the conduit.

3. The method of claim 2, wherein the upper plug is configured to slide to a lower end of the plugged portion of the conduit after the plugged portion of the conduit is placed at the desired placement location.

4. The method of claim 1, wherein the upper plug has a built-in valve configured to open after the plugged portion of the conduit is placed at the desired placement location.

5. The method of claim 1 wherein the upper plug has a built-in valve configured to open at a pressure above a certain threshold.

6. The method of claim 1 wherein the foam may be combined with gases, liquids and any combination thereof.

7. The method of claim 1 wherein the foam is configured to achieve a favorable conduit buoyancy in the well borehole.

8. The method of claim 1 wherein the foam is configured to achieve a favorable conduit wall resistance to external collapse forces.

9. The method of claim 1 wherein the foam is configured to achieve both a favorable conduit buoyancy in the well borehole and a favorable conduit wall resistance to external collapse forces.

10. The method of claim 1 wherein the pressure of the foam is at least 1.7 MPa (250 psi).

11. The method of claim 1 wherein the conduit is placed at the desired placement location within the well borehole by leading with the plugged portion.

12. The method of claim 1 wherein the method is performed in the recited order.

13. The method of claim 1 wherein the insertion of the foam into the plugged portion of the conduit is performed external to the well borehole.

14. The method of claim 1 wherein the insertion of the foam into the plugged portion of the conduit is performed at least partially external to the well borehole.

15. A method for inserting a conduit into a borehole penetrating a subterranean formation, the method comprising:

plugging at least a portion of the annulus between a conduit and an insertion string with an upper annular plug and a lower annular plug;

inserting pressurized fluid into the plugged portion of the annulus between the conduit and the insertion string;

placing the conduit, leading with the plugged section, at a desired placement location within a well borehole; and allowing the pressurized fluid to flow out of the plugged portion of the annulus between the conduit and the insertion string.

16. The method of claim 15, wherein the upper annular plug is configured to slide to a lower end of the plugged portion of the annulus between the conduit and the insertion string after the plugged portion of the annulus between the conduit and the insertion string is placed at the desired placement location.

17. The method of claim 15, wherein the upper annular plug has a built-in valve configured to open after the plugged portion of the annulus between the conduit and the insertion string is placed at the desired placement location.

18. The method of claim 15, wherein the upper annular plug has a built-in valve designed to open at a pressure above a certain threshold.

19. The method of claim 15 wherein the pressurized fluid comprises one of gases, liquids, foams, and any combination thereof.

20. The method of claim 15 wherein the pressure of the pressurized fluid is configured to achieve a favorable conduit buoyancy in the well borehole.

21. The method of claim 15 wherein the pressure of the pressurized fluid is configured to achieve a favorable conduit wall resistance to external collapse forces.

22. The method of claim 15 wherein the pressurized fluid is chosen to achieve both a favorable conduit buoyancy in the well borehole and a favorable conduit wall resistance to external collapse forces.

23. The method of claim 15 wherein the pressure of the pressurized fluid is at least 1.7 MPa (250 psi).

24. The method of claim 15 wherein the method is performed in the recited order.

25. The method of claim 15 wherein the insertion of the pressurized fluid into the plugged portion of the annulus between the conduit and the insertion string is performed external to the well borehole.

26. The method of claim 15 wherein the pressurized fluid is stable foam.

27. A method for inserting a conduit into a well borehole penetrating a subterranean formation, the method comprising:

securing an insertion string co-axially within a conduit;

plugging at least a portion of the insertion string with an upper plug and a lower plug;

inserting pressurized fluid into the plugged portion of the insertion string;

placing the conduit at a desired placement location within a well borehole; and allowing the pressurized fluid to flow out of the plugged portion of the insertion string.

28. The method of claim 27, wherein the upper plug is configured to slide to a lower end of the plugged portion of the insertion string after the plugged portion of the insertion string is placed at the desired placement location.

29. The method of claim 27, wherein the upper plug has a built-in valve configured to open after the plugged portion of the insertion string is placed at the desired placement location.

30. The method of claim 27 wherein the upper plug has a built-in valve configured to open at a pressure above a certain threshold.

31. The method of claim 27 wherein the pressurized fluid comprises one of gases, liquids, foams, and any combination thereof.

32. The method of claim 27 wherein the pressurized fluid is chosen to achieve a favorable conduit buoyancy in the wellbore.

33. The method of claim 27 wherein the pressure of the pressurized fluid is at least 1.7 MPa (250 psi).

34. The method of claim 27 wherein the conduit is placed at the desired placement location within the well borehole by leading with the plugged portion.

35. The method of claim 27 wherein the method is performed in the recited order.

36. The method of claim 27 wherein the insertion of the pressurized fluid into the plugged portion of the insertion string is performed external to the well borehole.

37. The method of claim 27 wherein the pressurized fluid is stable foam.

* * * * *